United States Patent [19]

Miura

[11] Patent Number: 4,756,753

[45] Date of Patent: Jul. 12, 1988

[54] PARTICLES DISPERSED ALUMINUM MATRIX COMPOSITES AND METHOD FOR MAKING SAME

[75] Inventor: Tsunemasa Miura, Oyamashi, Japan

[73] Assignee: Showa Aluminum Kabushiki Kaisha, Sakaishi, Japan

[21] Appl. No.: 89,526

[22] Filed: Aug. 26, 1987

[30] Foreign Application Priority Data

Sep. 4, 1986 [JP] Japan ..... 61-209152

[51] Int. Cl.[4] ..... C22C 29/12

[52] U.S. Cl. ..... 75/232; 75/236; 75/244; 419/11; 419/12; 419/13; 419/14; 419/17; 419/19; 419/23; 419/28; 419/29; 419/46; 419/57

[58] Field of Search ..... 419/11, 12, 14, 13, 419/28, 17, 57, 29, 19, 46, 23; 75/232, 236, 244

[56] References Cited

U.S. PATENT DOCUMENTS 4,292,079 9/1981 Pickens et al. ..... 75/232

4,297,136 10/1981 Pickens et al. ..... 75/234

*Primary Examiner*—Stephen J. Lechert, Jr.

[57] ABSTRACT

An aluminum matrix composite containing evenly dispersed reinforcement particles in the aluminum matrix wherein the contents of oxygen and carbon are controlled so that their volume percentage is not larger than 20% and wherein the contents of the reinforcement particles, oxygen and carbon are controlled so that their volume percentage is not larger than 40%. The control of oxygen and carbon is effected by carrying out the main process at a non-oxidizing atmosphere and minimizing the addition of an anti-seizure agent required to facilitate the mechanical alloying treatment.

7 Claims, 1 Drawing Sheet

PARTICLES DISPERSED ALUMINUM MATRIX COMPOSITES AND METHOD FOR MAKING SAME

BACKGROUND OF THE INVENTION

1. Field of the Invention

The present invention relates to an aluminum matrix composite, and a method for making same, wherein the term "aluminum" includes aluminum alloy. More particularly, the present invention relates to an aluminum matrix composite containing evenly dispersed reinforcement particles, and a method for making same.

2. Description of the Prior Art

To enable metal matrix composites to exhibit their characteristics the matrix preferably contains evenly dispersed reinforcement particles.

Recently the mechanical alloying method has become known in the field, which is designed to secure an even dispersion of reinforcement particles. According to the known mechanical alloying method a primary powdery composite is produced in which the reinforcement particles are strongly bonded to the matrix, and then the primary powdery composite is metallurgically processed into a secondary powdery composite. The mechanical alloying methods are already known in the art; for example, Japanese Patent Publication (unexamined) Nos. 60-131943, 60-1319 and 60-9837 disclose them.

However the matrix composites produced under the conventional metallurgical methods are less ductile and fragile. To use them for practical purposes a further process is required to increase the tenacity and heat-proofness.

The inventor has found out through study and researches that the insufficient tenacity is due to the presence of excessive amounts of oxygen and carbon which is unavoidably brought about during the mechanical alloying process. The oxygen and carbon shorten the average inter-particle distance to increase a restraint against dislocation, which makes the matrix composites less tenacious, and fragile.

OBJECTS AND SUMMARY OF THE INVENTION

The present invention aims at solving the problems pointed out with respect to the matrix composites produced by the known mechanical alloying methods, and has for its object to provide an aluminum matrix composites containing controlled amounts of oxygen and carbon in proportion to the amount of reinforcement particles, thereby increasing the tenacity and heat-proofness.

Another object of the present invention is to provide particles dispersed aluminum matrix composites having high wear-proof quality.

Other objects and advantages of the present invention will become more apparent from the following detailed description, when taken in conjunction with the accompanying drawings which show, for the purpose of illustration only, one embodiment in accordance with the present invention.

Figure 1:
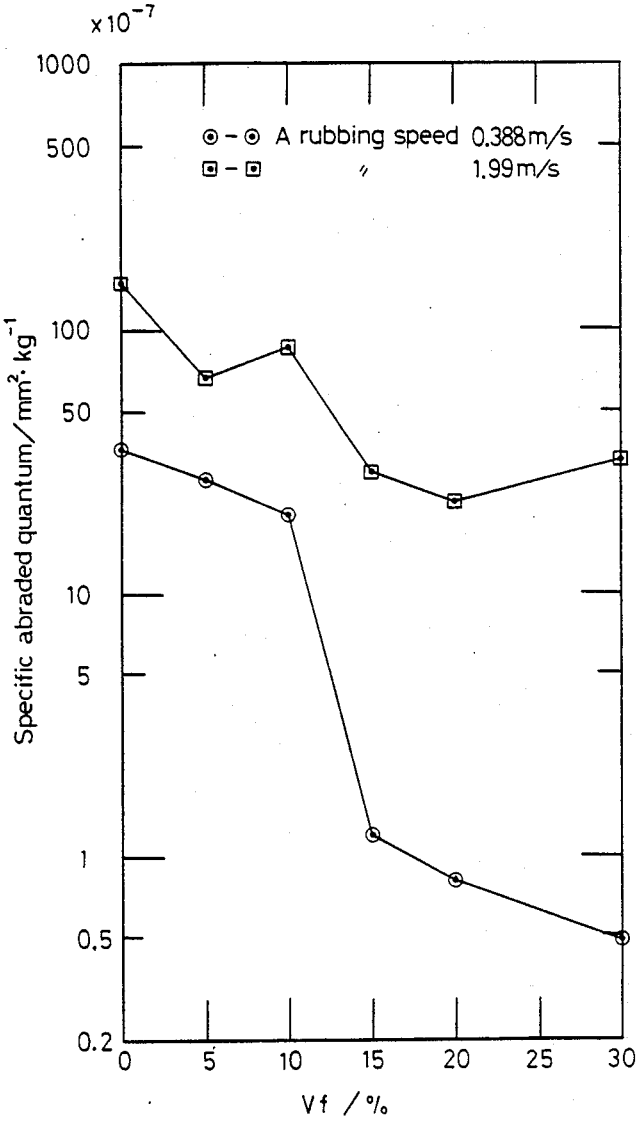
FIG. 1 shows specific abraded quantum as a function of volume percentage.

According to the present invention there is provided an aluminum matrix composite containing evenly dispersed reinforcement particles in the aluminum matrix, the composite comprising oxygen, carbon and the reinforcement particles to the extent that the volume percentage of oxygen and carbon is not larger than 20%, and that the volume percentage of the reinforcement particles, oxygen and carbon is not larger than 40%.

The weight percentage of oxygen and carbon are changed into the volume percentage; that is, $V_f(O_2+C)$.

Herein, $V_f(O_2+C)=1.71\times(\text{wt\% of } O_2)+3.71(\text{wt\% of carbon})$. This $V_f(O_2+C)$ must be not larger than 20%.

If the $V_f(O_2+C)$ exceeds 20% the average distance between the reinforcement particles is shortened, thereby increasing the restraint against a possible dislocation. This makes the matrix composite less ductile and fragile. Preferably, $V_f(O_2+C)$ should be equal to or less than 10%.

The ratio of reinforcement particles is 10% or more in terms of volume percentage. The upper limit is automatically given by the contents of oxygen and carbon; that is, 35% at maximum but preferably 25%. If the volume percentage of reinforcement particles is less than 10% no desired degree of wear-proofness will result. However if it exceeds 35% the ductility of the alloy will be remarkably reduced. Because of the increased fragility the alloy becomes difficult to work or process.

Taken into consideration the content of reinforcement particles, the following relationship must be satisfied:

$$V_f(O_2+C)+V_f(\text{reinforcement particle})\leqq 40\%.$$

If the volume percentage exceeds 40% the resulting composite will be less tenacious and fragile.

Suppose that the average diameter (l) of reinforcement particles is 10 μm or less; that is:

$$l\leqq 10\ \mu m$$

If the diameters of the individual reinforcement particles exceed 10 μm, they cannot be evenly dispersed, thereby decreasing the mechanical strength, dactility and Young's modulus. Preferably, the average diameter (l) of particles is 5 μm or less.

Basically the process of the aluminum matrix composites comprises mixing aluminum powder with reinforcement particles, applying a mechanical alloying treatment to a primary powdery mixture to obtain a secondary composite powder, placing the secondary composite powder in a pressure vessel in which it is heated to remove dissolved gases under reduced pressure, forming the composite powder into mass by heat under pressure, and applying a desired heat treatment to the mass. The above-described process can be carried out as a batch process or else it can be done as a series process in which the mechanical alloying treatment, the conveyance, the removal of gases by heat, the charging in a container, and the formation of mass and the final heat treatment are carried out in a sequence.

According to the present invention the series of processes described above are conducted at a vacuum or any other atmosphere at which oxidizing is avoided, thereby preventing oxygen from being introduced. Secondly the addition of an anti-seizure organic agent is minimized, thereby avoiding the presence of an excessive amount of carbon.

The anti-seizure agent includes ethanol or any other organic substances. As the more agent is added, the carbon content will increased. However, in order to facilitate the mechanical alloying process, at least 5 cc of agent is required for 10 kg of a mixture of aluminum powder and reinforcement particles. If the total amount exceeds 60 cc the problem of public hazard will result. The quantity of the mixture should be reduced to 40 cc or less.

In order to form the aluminum matrix, pure aluminum such as A100 type can be singly used or combined with other one or more types such as A2000 to A8000 type aluminum. The average diameter of aluminum powder is preferably 20 μm.

To make the reinforcement particles one or more types of substances selected from the ordinary oxides, carbides, nitrides, borides, intermetallic compounds can be used. For example, $Si_3N_4$, SiC, TiN, $Al_2O_3$, TiC, $TiSi_2$, MoSi, or $Ni_3Al$ can be used as the reinforcement particles. The amount of the reinforcement particles is desirably 5% to 40% by volume percentage; preferably, in the range of 10% to 35% by volume.

The matrix composites produced according to the present invention contains evenly dispersed reinforcement particles in the aluminum matrix under the mechanical alloying process, so that the composites are tenacious, ductile, and highly heat-resistance. Owing to these favorable properties the matrix composites of the present invention are of particular advantage when they are used for components of engines, especially connecting rods, in that their wall thickness can be minimized thereby to lead to the reduction of weight by 20% or more as compared with ones made of the known A2024 type aluminum alloy. When the composites are used for pistons the tensile strength is increased at 300° C. about three times as compared with that of the conventional pistons made of AC8A or AC8B alloys. Owing to the increased strength the pistons can be thin thereby to lead to the reduction of weight by about 30%. The light weight of engines increases the efficiency.

For better understanding examples will be described:

EXAMPLE (1)

TABLE 1

| | (Materials) | | | |
|---|---|---|---|---|
| | | Reinforcement Particles | | |
| Specimen No. | matrix powder | Kind | Average diameter (μm) | Volume Percentage |
| Com. 1 | pure Al | SiC | 0.4 | 35 |
| Inv. 2 | 6061 | $Al_2O_3$ | 1.0 | 25 |
| 3 | 2024 | Si3N4 | 0.4 | 30 |
| Com. 4 | pure Al | SiC | 0.4 | 10 |

One kilogram of the aluminum powder and reinforcement particles shown in Table (1) were mixed by an agitator at 2000 rpm for 4 minutes.

The powdery mixture was subjected to a mechanical alloying treatment at the atmosphere of argon at 280 rpm for 10 hours to obtain a composite powder. In the mechanical alloying process ethanol was added as the anti-seizure agent, whose quantities were varied with specimens as follows:

Specimen No. 1: 54 cc
Specimen No. 2: 22 cc
Specimen No. 3: 29 cc
Specimen No. 4: 73 cc.

The composite powder was collected and placed in a pressure vessel, wherein Specimens No. 1 to No. 3 were treated at the atmosphere of argon whereas Specimens No. 4 was at an atmosphere. The air in the vessel was withdrawn to a vacuum of $3\times10^{-3}$ torr, and the gases dissolved in the composite powder was removed at 500° C. for 5 hours. Then the powder was formed into a mass by means of a hot press at 500° C. under a pressure of 7000 kg/cm$^2$, and the mass was extruded at a ratio of 10:1 at 450° C. In this way aluminum matrix composites were obtained for the respective specimens.

After the composites obtained for Specimens Nos. 2 and 3 were subjected to a $T_6$ tempering treatment, but no treatment was applied to those for Specimens Nos. 1 and 4, the mechanical properties and the atmosphere of oxygen and carbon of each composite were examined, the results of which are shown in Tables (2) and (3):

TABLE 2

| | (Mechanical Properties) | | |
|---|---|---|---|
| Specimen No. | σB (kgf/mm$^2$) | E (kgf/mm$^2$) | δ (%) |
| | Room Temperature | | |
| com. 1 | 58 | 12500 | <1 |
| Inv. 2 | 60 | 11000 | 2.5 |
| 3 | 64 | 12000 | 2.0 |
| com. 4 | 52 | 8700 | <1 |
| | At 300° C. | | |
| com. 1 | 37 | 11000 | 3.5 |
| Inv. 2 | 33 | 9500 | 17 |
| 3 | 35 | 10500 | 14 |
| com. 4 | 35 | 7200 | 2.1 |

(Note)
com. stands for comparative.
Inv. stands for the invention.
σB: extension strength
E: Young's modulus
δ: Elogation percentage

TABLE 3

| | (Contents of oxygen and carbon) | | |
|---|---|---|---|
| Specimen No. | oxygen (wt %) | carbon (wt %) | oxygen and carbon $V_f$(%) |
| Com. 1 | 1.0 | 2.2 | 9.9 |
| Inv. 2 | 1.1 | 0.9 | 5.2 |
| 3 | 0.9 | 1.2 | 6.0 |
| Com. 4 | 8.0 | 3.0 | 25.0 |

As is evident from Tables 2 and 3 the specimen No. 1 contains an excessive amount of reinforcement particles, so that the total content of oxygen and carbon exceeds 40% even if the addition of them is restrained. The specimen No. 4 contains a greater amount of ethanol as an anti-seizure agent for the mechanical alloying method. In addition the after-treatment was conducted at an atmosphere, so that the content of oxygen and carbon increases until it exceeded 20%. As a result the specimens Nos. 1 and 4 have poor Elogation percentage percentage.

In contrast, the specimens Nos. 2 and 3 are superior in strength, tenacity and ductility, especially heat-resistance.

EXAMPLE 2

TABLE 4

| | (Material) | | | |
|---|---|---|---|---|
| | Matrix | Reinforcement Particles | | |
| Specimen No. | Al powder | species | diameter (μm) | $V_f$(%) |
| Inv. 5 | pure Al | SiC | 0.4 | 20 |
| 6 | 6061 | SiC | 0.4 | 20 |
| 7 | pure Al | $Al_2O_3$ | 8.0 | 30 |
| 8 | 2024 | $Al_2O_3$ | 5.0 | 30 |
| Com. 9 | pure Al | Sic | 30.0 | 20 |

TABLE 4-continued

| | (Material) | | | |
|---|---|---|---|---|
| | Matrix | Reinforcement Particles | | |
| Specimen No. | Al powder | species | diameter (μm) | $V_f$(%) |
| 10 | 6061 | $Al_2O_3$ | 15.0 | 30 |

One kilogram of the aluminum powder and reinforcement powder shown in Table 4 was subjected to the mechanical alloying treatment with the addition of 22 cc of ethanol as an anti-seizure agent, wherein the amount of ethanol was constant for all the specimens. The other working conditions were the same as those of Example 1.

The composite powder obtained from each specimen was collected and placed in a pressure vessel at the atmosphere of argon. The same treatment as that of Example 1 was applied to the composite powder, which was then extruded into mold. The specimens Nos. 7 and 10 were subjected to a series of processes after the mechanical alloying was finished.

The final composites from the specimens Nos. 6, 8 and 10 were subjected to the $T_6$ tempering, but those from the remaining specimens were subjected to no after-treatment. Then their mechanical properties were examined, and the contents of oxygen and carbon were measured, the results of which are shown in Tables 5 and 6:

TABLE 5

| | (Mechanical Properties) | | |
|---|---|---|---|
| Specimen No. | σB (kgf/mm²) | E (kgf/mm²) | δ (%) |
| | Room Temperature | | |
| Inv. 5 | 48 | 10700 | 3.2 |
| 6 | 58 | 10800 | 3.0 |
| 7 | 50 | 12000 | 2.2 |
| 8 | 60 | 12100 | 2.1 |
| com. 9 | 28 | 10500 | 1> |
| 10 | 35 | 11900 | 1> |
| | At 300° C. | | |
| Inv. 5 | 27 | 9200 | 19 |
| 6 | 35 | 9300 | 17 |
| 7 | 28 | 10500 | 13 |
| 8 | 38 | 10600 | 13 |
| com. 9 | 10 | 9000 | 3 |
| 10 | 12 | 10400 | 2 |

TABLE 6

| | (Contents of oxygen and carbon) | | |
|---|---|---|---|
| Specimen No. | oxygen (wt %) | carbon (wt %) | oxygen and carbon $V_f$(%) |
| Inv. 5 | 1.0 | 0.8 | 4.7 |
| 6 | 0.9 | 0.8 | 4.5 |
| 7 | 0.8 | 0.9 | 4.7 |
| 8 | 0.7 | 0.8 | 4.2 |
| Com. 9 | 1.0 | 0.9 | 5.1 |
| 10 | 0.8 | 0.9 | 4.7 |

As is evident from Tables 5 and 6, when the average diameter of the reinforcement particles is so coarse as to exceed 10 μm (Specimens Nos. 9 and 10), the tensile strength as well as elogation percentage decreases.

EXAMPLE 3

TABLE 7

| | (Material) | | | |
|---|---|---|---|---|
| | | reinforcement particles | | |
| specimen No. | matrix powder | kind | average diameter (μm) | Vf (%) |
| 11 | pure Al | $Al_2O_3$ | 0.5 | 5 |
| 12 | " | " | " | 10 |
| 13 | " | " | " | 15 |
| 14 | " | " | " | 20 |
| 15 | " | " | " | 30 |

Each specimen was produced by the same process as for the example 2, and tested with respect to its specific abraded quantum, which is shown in FIG. 1. The rubbing tests were conducted by the Ohkoshi method (dry) under the following conditions:

Rubbing speed: 0.388 m/s and 1.99 m/s
Rubbing object: FC-30
Rubbing range: 600 m
Final load: 2.1 kg.

As is evident from FIG. 1 the content of reinforcement remarkably increases the wear-proofness of composite alloys if the volume percentage thereof exceeds 10%.

What is claimed is:

1. A particles dispersed aluminum matrix composite, which comprises oxygen, carbon, and reinforcement particles, wherein the volume percentage of oxygen and carbon is not larger than 20%, and wherein the volume percentage of the reinforcement particles is 10% or more, and wherein the volume percentage of the reinforcement particles, oxygen and carbon is not larger than 40%.

2. An aluminum matrix composite as defined in claim 1, wherein the average diameter of the reinforcement particles is not larger than 10 μm.

3. An aluminum matrix composite as defined in claim 2, wherein the reinforcement particles are one or more substances selected from oxides, carbides, nitrides, borides, and intermetallic compounds.

4. A method for making An aluminum matrix composite, the method comprising:

mixing aluminum powder and reinforcement particles so as to obtain a primary powdery mixture, wherein the volume percentage of the reinforcement particles is 10% or more;

applying the powdery mixture to a mechanical alloying treatment so as to obtain a secondary powdery composite;

removing dissolved gases by heat from the powdery composite under reduced pressure;

applying pressure to the powdery composite in a confined space filled therewith so as to form it into a mass;

wherein the process from the mechanical alloying treatment up to the pressure application is carried out at a non-oxidizing atmosphere, and the addition of an anti-seizure agent is minimized so as to ensure the volume percentage of oxygen and carbon is not larger than 20%, and wherein the contents of oxygen, carbon and reinforcement particles are controlled to ensure that their volume percentage is not larger than 40%.

5. A method as defined in claim 4, wherein the reinforcement particles have an average diameter of not larger than 10 μm.

6. A method as defined in claim 5, wherein the reinforcement particles are one or more substances selected from oxides, carbides, nitrides, borides, and intermetallic compounds.

7. A method as defined in claim 4, wherein the quantity of the anti-seizure agent is limited to the range of 5 to 60 cc per 1 kg of a mixture of matrix powder and reinforcement particles.

* * * * *